US005853427A

United States Patent [19]

Kronick

[11] Patent Number: 5,853,427

[45] Date of Patent: Dec. 29, 1998

[54] USE OF POLYMERIZABLE OIL FOR LEATHER FATLIQUOR

[75] Inventor: Paul L. Kronick, Haverford, Pa.

[73] Assignee: The United States of America as represented by the Secretary of Agriculture, Washington, D.C.

[21] Appl. No.: 933,979

[22] Filed: Sep. 19, 1997

Related U.S. Application Data

[60] Continuation of Ser. No. 758,028, Nov. 27, 1996, abandoned, which is a division of Ser. No. 501,526, Jul. 12, 1995, Pat. No. 5,607,807.

[51] Int. Cl.[6] ..... C14C 9/02

[52] U.S. Cl. ..... 8/94.23; 8/94.21; 8/94.22; 427/389

[58] Field of Search ..... 8/94.21, 94.22, 8/94.23; 427/389

[56] References Cited

U.S. PATENT DOCUMENTS

| | | | |
|---|---|---|---|
| 59,736 | 11/1866 | Sourzac | 8/94.22 |
| 3,291,558 | 12/1966 | Bader et al. | 427/389 |
| 3,485,573 | 12/1969 | Heyden | 8/94.22 |
| 4,074,968 | 2/1978 | Lipowski et al. . | |
| 4,106,898 | 8/1978 | Traubel et al. . | |
| 4,268,580 | 5/1981 | Rock et al. | 427/389 |
| 4,443,221 | 4/1984 | May et al. . | |
| 4,596,581 | 6/1986 | Hohr et al. . | |
| 4,828,570 | 5/1989 | Riegel et al. . | |
| 5,728,313 | 3/1998 | Ritter et al. | 252/8.57 |

OTHER PUBLICATIONS

Leather Facts, New England Tanners Club, 1965, p. 20. (Month Unknown).

*Primary Examiner*—Alan Diamond
*Attorney, Agent, or Firm*—M. Howard Silverstein; John D. Fado; Janelle S. Graeter

[57] ABSTRACT

Novel fatliquoring compositions used for treating mineral-tanned leathers are effective substitutes for oils which have conventionally been used to soften leather. The compositions comprise monomers which polymerize in situ and soften the leather by breaking the leather fibers into smaller units which can move about when the leather is deformed. Useful monomers are unsaturated phosphatidyl esters, such as phosphatidyl choline, and unsaturated fatty monomers, such as esters of unsaturated fatty alcohols and acrylic acid and vinyl esters of unsaturated fatty acids.

18 Claims, No Drawings

USE OF POLYMERIZABLE OIL FOR LEATHER FATLIQUOR

This application is a continuation, of application Ser. No. 08/758,028, filed Nov. 27, 1996 now abandoned, which is a division, of application Ser. No. 08/501,526 filed Jul. 12, 1995 now U.S. Pat. No. 5,607,807.

BACKGROUND OF THE INVENTION

1. Field of the Invention

This invention relates to a composition used as a fatliquoring agent and a method of utilizing the composition for treating mineral-tanned leathers. The composition comprises monomers which polymerize in situ and act as a substitute for oils which are currently used to soften the leather. Useful monomers are unsaturated phosphatides, such as diacetylenic phosphatidyl choline, hydrophylic polymers with spaced, fatty diglyceride side-chains and unsaturated fatty monomers, such as esters of unsaturated fatty alcohols and acrylic acid, vinyl esters of unsaturated fatty acids and corresponding compounds derived from other unsaturated fats with chain lengths from about 15C to about 25C and which are liquid at room temperature when mixed with comonmers.

2. Description of the Prior Art

Conventional methods of softening chrome-tanned leather are carried out by adding fatliquoring agents to the leather before it is dried, to the extent of 30% of fatty materials. The fatliquoring agents are in the form of emulsions containing oils such as fish oils, soy oil, coconut oil, linseed oil, olive oil and rapeseed oil. Surfactants used to make the emulsions may be sulfates or sulfonates of the oils, alkyl sulfates, alkyl phosphates or lecithin (E. Heidemann, *Fundamentals of Leather Manufacturing*, E. Roether KG, 1993, Chapter 15).

The oils make the leather soft by imparting a fluid phase into the leather. This phase is not well fixed in the leather, however, and migration out of the leather occurs over time, particularly when it is wet with water or solvents or sublimation at elevated temperatures (in sunlight, for example) occurs. Further, they generally eventually result in yellowing and/or inappropriate odors, and they interfere with adhesives used in shoemaking and with the adhesion of coatings used in finishing. The amount of oil used is also far in excess of that which is known to be necessary in the final product (G. Reich and H. Oertel, 1987. *Das Leder*. vol. 38, pp. 41–47).

Fatty acrylic polyelectrolytes (A. El A'mma et al. 1991. *J. Am. Leather Chemists Assn*. vol. 86, pp. 1–7) have been used to soften leather instead of low molecular weight oils. These are designed to bind to the metal ions used in tanning, mainly chromium III. They are not as effective as the more conventional oils used in softening leather, however, perhaps because they neither isolate the 100-nm fibrils that constitute the leather nor cause the formation of 5 $\mu$m fibers found when conventional oil emulsions are used (A. Alexander et al. 1993. *J. Am Leather Chemists Assn*. vol. 88, pp. 254–269).

In order to overcome the problems associated with conventional oil-based fatliquoring procedures, efforts have been made to discover fatliquoring procedures and compositions which result in improved leather products.

SUMMARY OF THE INVENTION

Fatliquor compositions have been discovered which are effective for treating mineral-tanned leather and result in leather having improved sensory and visual properties such as softness and the ability to retain dyes, adhesives and other additives necessary for the manufacture of leather articles.

In accordance with this discovery, it is an object of the invention to provide novel fatliquor compositions for the treatment of leather.

It is also an object of the invention to provide a method of treating leather using the novel compositions.

Other objects and advantages will become readily apparent from the following description.

DETAILED DESCRIPTION OF THE INVENTION

This invention is a method of making soft chrome-tanned leather using materials that are fixed within the leather. The materials are insoluble high polymers that soften the leather by breaking the leather fibers into smaller units which can move about when the leather is deformed.

Two types of polymers can be used. One polymer self-organizes into planar sheets which coat the 100-nm fibrils, separating them and making them mobile. The polymers are made from unsaturated phosphatidyl ester monomers which, in aqueous suspensions, can form molecular layers about the collagen fibrils. When a polymerization initiator is introduced at an elevated temperature, the monomer forms a polymer that is fixed in place at the fibril level of structure in the leather. Useful monomers are linolenyl phosphatidyl choline or 1,2-bis(10,12-tricosadiynoyl) phosphatidyl choline. Useful polymerization initiators are benzoyl peroxide or azo-bis-isobutyronitrile. For better fixation, i.e. to prevent migration in the leather, the polymer can be crosslinked.

The other type of polymer is made from unsaturated fatty monomers having chain lengths from about 15C to about 25C. These small lipid molecules are polymerized in situ among the fibers of the wet leather. This type of monomer is present in the form of micelles, which are sufficiently small that they diffuse freely in the interstices of the leather. Since these interstices are mostly about 1 $\mu$m to about 10 $\mu$m, micelles, usually as small as about 10 nm, are effective. Again, the polymer that is formed can be crosslinked to form a network which cannot migrate in the leather.

Useful fatty monomers are those which can be polymerized below 100° C. in the presence of water to give polymers with glass transition temperatures below the temperatures at which the leather would be used, i.e. about −30° C. They also must be liquid at the temperature at which they are dispersed in the aqueous system before polymerization. Useful monomers are esters from an unsaturated fatty alcohol and acrylic acid such as oleyl acrylate, or a vinyl ester of an unsaturated fatty acid such as vinyl oleate. Mixtures of saturated fatty esters may also be used, provided the melting point is below the temperature at which they are dispersed. Other useful monomers include acrylates of unsaturated fatty alcohols such as oleyl alcohol, acrylates of branched-chain alcohols such as $RR'CHCH_2OH$ where R and R' are butyl and decyl, hexyl and octyl, or heptyl and heptyl, respectively. Vinyl-alkenyl ethers and vinyl esters of unsaturated fatty acids can be used. Saturated linear vinyl esters are not recommended because the emulsification and polymerizations must be carried out above the melting points.

The monomers are dispersed in water with an anionic, nonionic or cationic surfactant. Useful surfactants are sodium dodecyl sulfate, polyethylene oxide, octadecyl trimethyl ammonium sulfate or lecithin. Enough surfactant should be used to keep the particle size well below 1 $\mu$m to permit penetration of the wet leather.

The treatment procedure is carried out by a) dispersing monomers in aqueous solution to form a fatliquor composition, b) combining the fatliquor composition with mineral-tanned leather and agitating the mixture, c) drying the treated leather at an elevated temperature and d) washing the dried treated leather to remove unpolymerized material.

Optionally, the monomer composition can include a crosslinker such as ethylene dimethacrylate.

In step a) phosphatidyl monomers are effectively dispersed as emulsions in water. Fatty monomers, however, are present in solution in the form of micelles which are sufficiently small that they are able to diffuse through interstices of about 1 to about 10 $\mu$m, i.e. less than 1 $\mu$m. The micelles are formed by emulsifying the monomers in the presence of sufficient surfactant to keep the micelles below 1 $\mu$m in size. The surfactant concentration should exceed critical micelle concentration for the particular surfactant utilized. The monomer mixture may contain only one type of monomer or may be a mixture of two or more monomers. It is well within the skill of the art to determine which monomers will react to form effective polymers. In addition, the fatliquor composition may also include a non-polar free radical generator such as benzoyl or cumyl peroxide or azo-bis-isobutyronitrile if polymerization is to be carried out during the drying step of the procedure. Additives to the fatliquor composition, such as polymerization initiators, are added in amounts effective for causing polymerization to occur.

Step b) is carried out by mixing the mineral-tanned hide or leather with the fatliquor composition and agitating for a time sufficient for the monomers to penetrate the leather. The treatment may be carried out at temperatures of about 25° C. to about 100° C. Optionally, it may be carried out in the absence of air, such as under $CO_2$. The composition may also include an ammonium (or sodium) persulfate-sodium bisulfite system, thus enabling the polymer to form while the composition is being added to the leather. In this instance, the treatment is carried out at about 40° C. to about 50° C.

Step c) is carried out at temperatures sufficiently high for polymerization to occur, at least about 50° C. and up to about 100° C. The treated leather may be either dried at a lower temperature (e.g. about 50° C.) followed by heat treatment at a higher temperature (e.g. about 80° C.) or dried continuously at the same temperature.

Step d) is carried out using any effective solvent for the particular monomer present in the fatliquor composition. For example, an organic solvent such as hexane is effective for removing phosphatidyl monomers while an alcohol such as isopropanol is effective for the fatty monomers.

Dried leather treated in this manner may subsequently be utilized in the manufacture of leather-containing articles by conventional methods.

The following examples are intended only to further illustrate the invention and are not intended to limit the scope of the invention as defined by the claims.

EXAMPLES

Example I

Crude linolenyl phosphatidyl choline was prepared by vigorously stirring phosphatidyl choline (12.0 g, 15 mmole), linolenic acid (8.35 g, 30 mmole), and 2 g "liposyme" enzyme were stirred vigorously in 500 ml toluene under nitrogen at room temperature for 20 hours. After removal of the enzyme and evaporation of the toluene with nitrogen, the residue was emulsified in 300 ml water. The emulsion was agitated with 100 g chrome-tanned leather under carbon dioxide at 45° C. for 30 minutes. Sodium persulfate (3.0 g) and sodium bisulfite (3.0 g) were then added, and the system was agitated at 45° C. for 5.5 hours. The leather was removed and dried in air under restraint so that it could not shrink at 60° C. for 17 hours. After having been dried, it was washed with hexane to remove unpolymerized material. A control was also prepared, which contained no phosphatidyl choline or linolenic acid. The treated product, unlike the control, was soft leather.

Example II

Ten grams of chrome-tanned hide ("bluestock"), vinyl oleate (12.0 g), 3.0 g each of sodium persulfate, sodium bisulfite and a nonionic surfactant were mixed in 1-L containers with 300 ml water. Sufficient solid carbon dioxide was added to displace the air; the jars were sealed and their contents were agitated for 4 hours at 40° C. to 45°. Control samples were treated in similar fashion, but no monomer was added. After polymerization, the hide was cooled, washed with cold water, and dried under dimensional restraint in air at room temperature. Unreacted monomer was removed with isopropanol by washing. They were then conditioned for 24 to 48 hours at 70° F. and 50% relative humidity before tensile testing. The untreated leather had strain at break, 84.3% ±19.0 and secant modulus, 6.98±1.58; the treated, 109.5% ±20.0 and 4.12±0.80, respectively. Therefore the polymer made the leather tougher and softer. The polymer also caused the leather to be stretched with little emission of acoustic pulses, characteristic of fatliquored leather, and it also comprised characteristic 5-$\mu$m fiber bundles.

Example III

Fifty g of wet chrome-tanned leather ("bluestock") was tumbled end-over-end for 18 hours at room temperature in a jar with a mixture of 3 g oleyl acrylate, 3 mg dicumyl peroxide, 300 mg Triton X-100® (Rohm and Haas Co. octylphenol-polyether, molecular weight 625 Da) amd 200 ml water. The leather was drained, dried in a draft oven at 50° C. and heated under nitrogen for 4 hour at 80° C. The resulting soft leather could be re-wet and dried again without hardening. On examination with the scanning electron microscope it was found that the fibers, originally measuring about 100 $\mu$m laterally, were broken into 5-$\mu$m strands, as expected for a leather dried with a fatliquor.

I claim:

1. A method of treating mineral-tanned leather, said method comprising a) combining said leather with a fatliquor composition to form a mixture, b) agitating the mixture of leather and fatliquor composition, c) drying the leather from step b) at elevated temperature so as to polymerize the monomers, and d) washing the dried treated leather with a solvent, wherein said fatliquor composition comprises monomers dispersed in aqueous solution, and wherein said monomers are unsaturated phosphatidyl ester monomers or unsaturated fatty monomers having chain lengths from about 15C to about 25C and are esters of unsaturated fatty alcohols and acrylic acid, vinyl esters of unsaturated fatty alcohols, vinyl alkenyl ethers or vinyl esters of unsaturated fatty acids, acrylates of branched-chain alcohols having the formula $RR'CH_2OH$ where R and R' are butyl and decyl, hexyl and octyl or heptyl and heptyl, respectively, or mixtures thereof.

2. The method of claim 1, wherein step b) is carried out at a temperature of about 25° C. to about 100° C.

3. The method of claim 2, wherein said step b) is carried out in the absence of air.

4. The method of claim 1 or 2, wherein said fatliquor composition further comprises ammonium persulfate and sodium bisulfite or sodium persulfate and sodium bisulfite and said step b) is carried out at a temperature of about 40° C. to about 50° C.

5. The method of claim 1, wherein step c) is carried out at a temperature of about 50° C. to about 100° C.

6. The method of claim 1, wherein the monomers are unsaturated phosphatidyl ester monomers.

7. The method of claim 6, wherein the unsaturated phosphatidyl ester monomers are linolenyl phosphatidyl choline or 1,2-bis(10,12-tricosadiynoyl)phosphatidyl choline.

8. The method of claim 6, wherein said fatliquor composition additionally comprises a polymerization initiator.

9. The method of claim 8, wherein said polymerization initiator is benzoyl peroxide or azo-bis-isobutyronitrile.

10. The method of claim 1, wherein said monomers are the unsaturated fatty monomers having chain lengths from about 15C to about 25C and said fatliquor composition additionally comprises an anionic, nonionic or cationic surfactant.

11. The method of claim 1 or 10, wherein said fatty monomers are oleyl acrylate, vinyl oleate, acrylates of branched-chain alcohols having the formula $RR'CHCH_2OH$ where R and R' are butyl and decyl, hexyl and octyl or heptyl and heptyl, respectively, or mixtures thereof.

12. The method of claim 10, wherein said surfactant is sodium dodecyl sulfate, polyethylene oxide, octadecyl trimethyl ammonium sulfate or lecithin.

13. The method of claim 1, wherein said fatliquor composition additionally comprises a crosslinker.

14. The method of claim 13, wherein said crosslinker is ethylene dimethacrylate.

15. The method of claim 1, wherein said fatliquor composition additionally comprises ammonium persulfate and sodium bisulfite or sodium persulfate and sodium bisulfite.

16. The method of claim 1, wherein said fatliquor composition additionally comprises a free radical generator.

17. The method of claim 16, wherein said free radical generator is cumyl peroxide or azo-bis-isobutyronitrile.

18. The method of claim 1, wherein said monomers are present as micelles of less than about 1 $\mu$m in size.

* * * * *